US005458847A

United States Patent [19]

Hu

[11] Patent Number: 5,458,847

[45] Date of Patent: Oct. 17, 1995

[54] ELECTROLESS PLATING METHOD OF NI-AL INTERMETALLIC COMPOUND

[75] Inventor: Chen-Ti Hu, Taipei, Taiwan

[73] Assignee: National Science Council, Taipei, Taiwan

[21] Appl. No.: 125,318

[22] Filed: Sep. 22, 1993

[51] Int. Cl.[6] ..... B22F 3/00

[52] U.S. Cl. ..... 419/61; 419/62; 427/304; 427/305; 427/306; 75/370; 75/371

[58] Field of Search ..... 423/140, 142, 423/143; 427/304, 305, 306; 75/370, 371; 419/61, 62

[56] References Cited

U.S. PATENT DOCUMENTS

| | | | |
|---|---|---|---|
| 3,922,396 | 11/1975 | Speirs et al. | 427/250 |
| 3,962,494 | 6/1976 | Nuzzi | 427/304 |
| 4,169,171 | 9/1979 | Narcus | 427/624 |
| 4,234,628 | 11/1980 | DuRose | 427/305 |
| 4,349,390 | 9/1982 | Olsen et al. | 427/304 |
| 5,167,992 | 12/1992 | Lin et al. | 427/437 |

*Primary Examiner*—Donald P. Walsh
*Assistant Examiner*—John N. Greaves
*Attorney, Agent, or Firm*—Christie, Parker & Hale

[57] ABSTRACT

A electroless plating method of an Ni—Al intermetallic compound includes steps of a) providing a reducing solution containing a reducing agent and reducing nickel ions, b) adding a proper amount of aluminum powder to the reducing solution, and c) permitting the reducing agent to reduce the reducing nickel ions to be deposited on the aluminum powder. Such electroless plating method permits the Ni—Al compound to be produced inexpensively/efficiently/fastly.

29 Claims, 8 Drawing Sheets

ELECTROLESS PLATING METHOD OF NI-AL INTERMETALLIC COMPOUND

BACKGROUND OF THE INVENTION

The present invention relates generally to the family of Ni—Al intermetallic compounds, and more particularly to a preparing method thereof.

The Ni—Al intermetallic compounds such as $Ni_3Al$ (Γ') has demonstrated extraordinary properties: high melting point, high ordering energy, thermal hardening, good resistance to oxidation and relatively small density. Those properties make it attractive for aerospatial and structural applications at elevated temperatures.

One of the techniques for forming the Ni—Al intermetallic compounds is obtained by vacuum melting and vacuum investment casting which is mostly used by the Metals and Ceramics Division of Oak Ridge National Laboratory, U.S.A.. Owing to the following suffered disadvantages: a) this compound has a relatively high melting point to be hard to be melted, b) the metal-crucible and metal-ceramic interactions are prone to be caused during the melting and investment casting, c) the cast is apt to have shrinking pores, and d) the cast is too hard to be worked, there are many difficulties encountered according to this technique.

Another technique for forming the Ni—Al intermetallic compound is the powder metallurgy (PM). This technique can permit us to obtain a compound with a relatively high yield rate, accurate dimensions, and a satisfactory microstructure and to easily control the components thereof.

One of the powder metallurgy techniques is the sintering of pre-alloyed powder which mainly processes by the rapid solidification process (RSP), the powder or ribbons by hot isostatic pressing or hot extrusion. Although the final product is of a high sintering density, there is still a key disadvantage: this technique includes too many procedures which have to employ many expensive equipments and to operate under a protective atmosphere. Besides, the tensility and the hardness of the pre-alloyed powder are both so high that the green forged parts cannot be easily formed and will wear the mold off easily.

Another powder metallurgy technique is the mechanical alloying which processes the pure metal powder in a protective atmosphere by the high-energy ball milling to lower the sintering temperature. According to this technique, some dispersion strengthening particles are added to achieve grain refining and strength increasing. The disadvantages of this technique are a) the procedure takes too much time, b) the obtained powder is so hard that the pressure for formation is therefore high, c) the ball-milling step causes the pollution problem, and d) the sintering density after the ball milling procedure is lowered.

A further powder metallurgy technique is the reactive sintering. This technique uses the inexpensive elemental metal powder which is softer than the pre-alloyed powder for the initial material, so there are the following disadvantages: a) the formation thereof is easy to be obtained, b) the sintering temperature can be lowered down to a large scale, c) the sintering time can be shortened. Whereas, there are also disadvantages: a) the pores are prone to be generated when the reaction heat and the difference of the elemental diffusion rates are high, b) the densification is hard to be obtained, c) the protective atmosphere such as argon, hydrogen, and helium is necessary for preventing the oxidation of aluminum powder, and d) the densified compound is sensitive to the processing parameters such as the heating rate, the interfacial quality, the temperature, and the particle size. It is also noted that in case a high density sintered body is to be obtained, a higher heating rate, a finer powder (in μm order) and an externally applied pressure during sintering are all needed, but the equipments to meet with above requirements are extremely expensive.

A further technique for forming the Ni—Al compounds is chemical technique. The initial material $NiCl_2$ and $AlCl_3$ are processed by the co-deposition method to obtain a nickel-aluminum organometallic complex. After a first thermal treatment lower than 1000° C. to burn off the organic function groups to obtain the mixture of $Ni_3C$ and the non-crystalline $Al_2O_3$ and free carbon, and after a second stage of heat treatment above 1300° C. to obtain the intermetallic compound, the $Ni_3Al$ and NiAl powder whose diameters are below 3 μm are formed. Whereas, this technique whose cost is too high and whose speed is too slow cannot economically meet with the industrial demand.

It is therefore attempted by the Applicant to deal with the above situation encountered by the prior art.

SUMMARY OF THE INVENTION

The primary object of the present invention is to provide an electroless plating method for producing the family of Ni—Al compounds (i.e., $Ni_3Al$, NiAl etc.) inexpensively/effectively/fastly.

Another object of the present invention is to provide an electroless plating method for producing the family of Ni—Al compounds by replacement reaction to form a nickel layer on the surface of the aluminum powder as an Ni—Al composite powder.

Another object of the present invention is to provide a preparing method of an Ni—Al compound by oxidation and reduction reaction to deposit the reduced nickel ions on the nickel layer of the Ni—Al composite powder.

A further object of the present invention is to provide a method especially suitable for executing plating action on the surface of the powder.

Another object of the present invention is to provide a composite powder softer than the both pre-alloyed powder and the mechanical alloying powder for being formed easily. Still an object of the present invention is to provide an electroless plating method of an Ni—Al compound which can shorten the diffusion distance for forming the Ni—Al intermetallic compounds.

One more objective of the present invention is to provide a Ni—Al intermetallic compounds having a higher constituent uniformity.

Furthermore objective of the present invention is to provide a Ni—Al intermetallic compound preparing method whose electroless plating solution containing boron ions permits boron uniformly distributed in the plating layer.

Further more object of the present invention is to provide an Ni—Al intermetallic compound preparing method which can solve the problems of processing difficulty and difficult formation for the compounds.

Once more object of the present invention is to provide an Ni—Al intermetallic compounds preparing method which applies inexpensive and simple equipments.

Yet more object of the present invention is to provide an Ni—Al intermetallic compounds whose nickel layer can lessen or avoid the oxidation of the aluminum powder.

In accordance with the present invention, a preparing method of an Ni—Al intermetallic compounds includes steps of a) providing a reducing solution containing a reducing agent and reducing nickel ions, b) adding a proper amount of aluminum powder to the reducing solution, and c) permitting the reducing agent to reduce the reducing nickel ions to be deposited on the aluminum powder.

Certainly, the aluminum powder can be processed by a pre-treatment procedure. The pre-treatment procedure can include steps of defatting, flushing with a basic solution, and flushing with a acid solution. The pre-treatment procedure can further include a step of subjecting the aluminum powder to an ultrasonic vibration to speed up a reaction therefor and improve a uniformity of the aluminum powder.

Alternatively, the pre-treatment procedure can include steps of d) providing the aluminum powder, e) providing a replacing solution containing replacing nickel ions, and f) permitting the replacing nickel ions to replace aluminum ions ionized from the aluminum powder for forming a thin nickel layer on a surface of the aluminum powder.

Certainly, the aluminum powder whose purity can be about 99.5% and whose average diameter can be about 22 μm. The replacing solution can include a salt and a reducing agent and can further include at least one selected from a group consisting of a pH regulator, a buffer, a complexing agent, a stabilizer, and an improver.

Certainly, the replacing solution can include nickel chloride ($NiCl_2.6H_2O$), sodium citrate ($Na_3C_6H_5O_7.2H_2O$), ammonia chloride ($NH_4Cl$), and ammonium water ($NH_4OH$) regulating the pH value of said replacing solution above 7, and the pH value can be properly chosen between about 9 and about 11. The replacing solution can include nickel chloride ($NiCl_2.6H_2O$), sodium citrate ($Na3C_6H_5O_7.2H_2O$), ammonium chloride ($NH_4Cl$), sodium fluoride (NaF) and ammonium water ($NH_4OH$) regulating the pH value of the replacing solution above 7, and the pH value can be properly chosen between about 7.5 and about 9.5.

Certainly, the reducing solution can include a salt and a reducing agent, and can further include a pH value regulator, a buffer, a complexing agent, a stabilizer, and an improver.

Certainly, the reducing solution can have a pH value ranging from about 7 to 8 and a reaction temperature about 70° C., and can include nickel chloride ($NiCl_2.6H_2O$), dimethylamine borane (DMAB), sodium acetate ($CH_3COONa.3H_2O$), and lead nitrate ($Pb(NO_3)_2$). The reducing solution can have a pH value ranging from 7 to 8 and a reaction temperature about 70° C. and can include nickel chloride ($NiCl_2.6H_2O$), dimethylamine borane (DMAB), sodium citrate ($Na_3C_6H_5O_7.2H_2O$), ammonium chloride ($NH_4Cl$), and lead nitrate ($Pb(NO_3)_2$).

The reducing solution can have a reaction temperature at room temperature, and can include nickel chloride ($NiCl_2.6H_2O$), dimethylamine borane (DMAB), ammonia water ($NH_4OH$), and ammonium chloride ($NH_4Cl$). The reducing solution can have a reaction temperature at room temperature, and can include nickel chloride ($NiCl_2.6H_2O$), dimethylamine borane (DMAB), sodium citrate ($Na_3C_6H_5O_7.2H_2O$), and ammonia water ($NH_4OH$).

The reducing solution can have a pH value ranging from about 6 to about 7 and a reaction temperature about 70° C., and can include nickel chloride ($NiCl_2.6H_2O$), dimethylamine borane (DMAB), malonic acid ($HOOCCH_2COOH$), and thiourea ($NH_2COSC_2H_5$).

The reducing solution can have a pH value ranging from about 7 to about 8 and a reaction temperature at room temperature, and can include nickel chloride ($NiCl_2.6H_2O$), sodium borohydride ($NaBH_4$), sodium citrate ($Na_3C_6H_5O_7.2H_2O$), ammonium chloride ($NH_4Cl$), and lead nitrate ($Pb(NO_3)_2$). The reducing solution can have a pH value ranging from about 8 to about 10 and a reaction temperature at room temperature, and can include nickel chloride ($NiCl_2.6H_2O$), sodium borohydride ($NaBH_4$), ammonia water ($NH_4OH$), and lead nitrate ($Pb(NO_3)_2$.

The reducing solution can have a pH value ranging from about 8 to about 10 and a reaction temperature at room temperature, and can include nickel chloride ($NiCl_2.6H_2O$), sodium borohydride ($NaBH_4$), ammonium chloride ($NH_4Cl$), sodium citrate ($Na_3O_6H_5O_7.2H_2O$), sodium acetate ($CH_3COONa.3H_2O$), and lead nitrate ($Pb(NO_3)_2$). The reducing solution can have a pH value ranging from about 8 to about 10 and a reaction temperature about 80° C., and can include nickel acetate ($Ni(C_2H_3O_2)_2.4H_2O$), hydrazine hydrate ($N_2H_4.H_2O$), 2 hydroxylacetic acid ($HOCH_2COOH$), and ethylenediaminetetraacetic acid (EDTA).

Certainly, the reducing solution can contain boron ions for forming an Ni—B—Al composite powder. The present method can further include steps of g) providing a pure nickel powder, and h) adding a proper amount of the pure nickel powder in the reducing solution at a proper time for forming an Ni—B—Ni composite powder, and i) obtaining a mixture of the Ni—B—Al composite powder and the Ni—B—Ni composite powder. The proper amount of pure nickel powder can further adjust a concentration of the boron ions.

Certainly, the nickel powder can have a purity is about 99.9% and an average diameter can be about 5μm. The reaction temperature of the reducing solution can range from about 0° C. to about 100° C.

Certainly, the present method can further include steps of j) drying the mixture, k) executing a first heat treatment at about 450° C. in a vacuum tube furnace with less than about $10^{-5}$ torr to degas the mixture, l) canning the mixture in a stainless steel tube in air, m) sealing both ends of the tube, and n) cold-rolling the tube containing the mixture to form a composite flake.

Certainly, the Ni—Al intermetallic compound can be one selected from the group consisting of $Ni_3Al$, NiAl, $Ni_2Al_3$, $NiAl_3$, $Ni_3Al$+B, NiAl+B, $Ni_2Al_3$+B, and $NiAl_3$+B.

Certainly, the composite flake can be sintered at about 1200° C. for forming a sintered specimen. Alternatively, the composite flake can be pre-sintered by a second heat treatment at about 650° C. for forming pre-sintered specimens; the pre-sintered specimens are then sintered by a third heat treatment at about 1200° C. for forming sintered specimens; and the sintered specimens are then released from the tube, and cold-rolled, and homogenized at about 1200° C.

The present invention can be more fully understood by reference to the following description and accompanying drawings which form an integral part of this application:

BRIEF DESCRIPTION OF THE DRAWINGS

FIG. 4 shows a relation between the Al content of the

Figure 5:
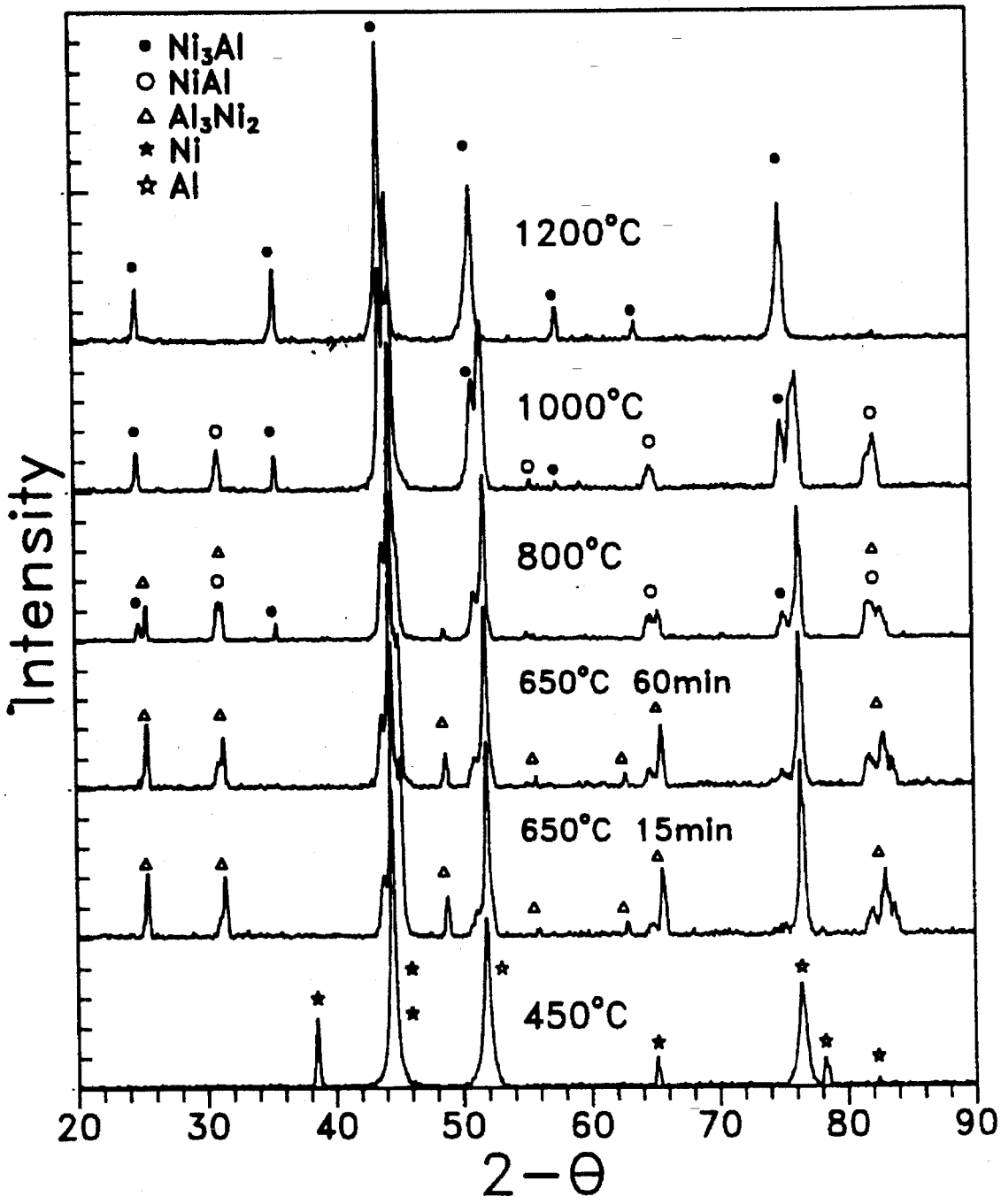

Ni—Al compound and the weight of the added aluminum powder by varying the weight of the added aluminum powder at a certain plating condition 4;

FIG. 5 shows X-ray diffraction patterns of various stages in the sintering process.

Figure 6:
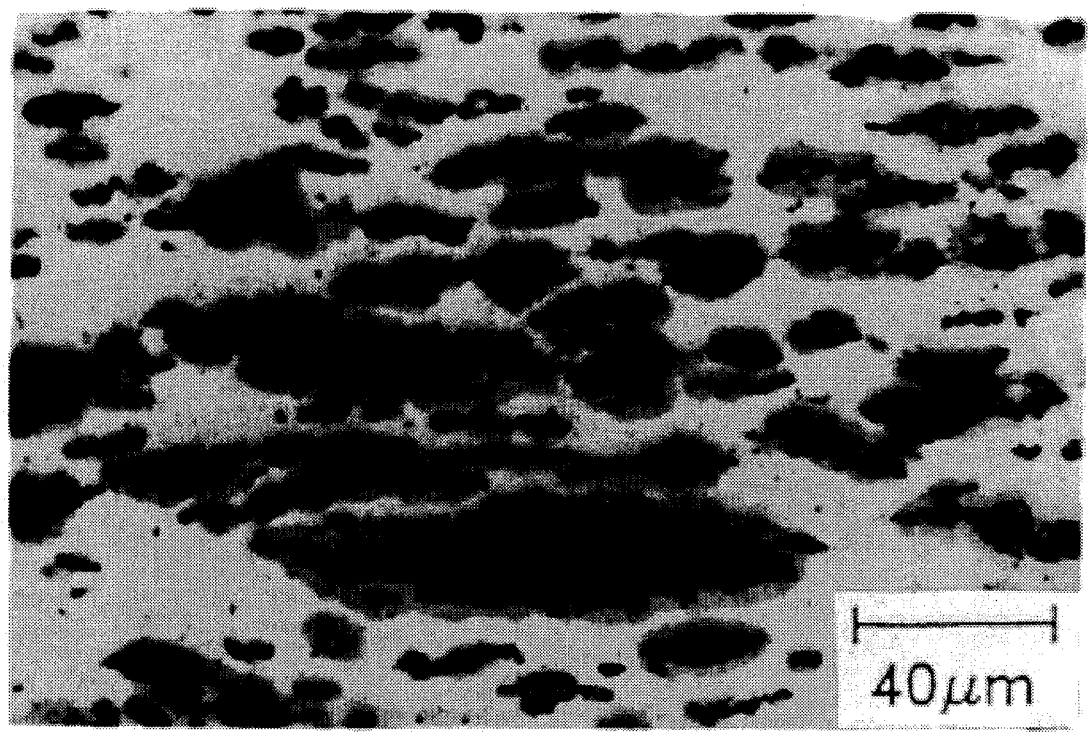
Figure 7:
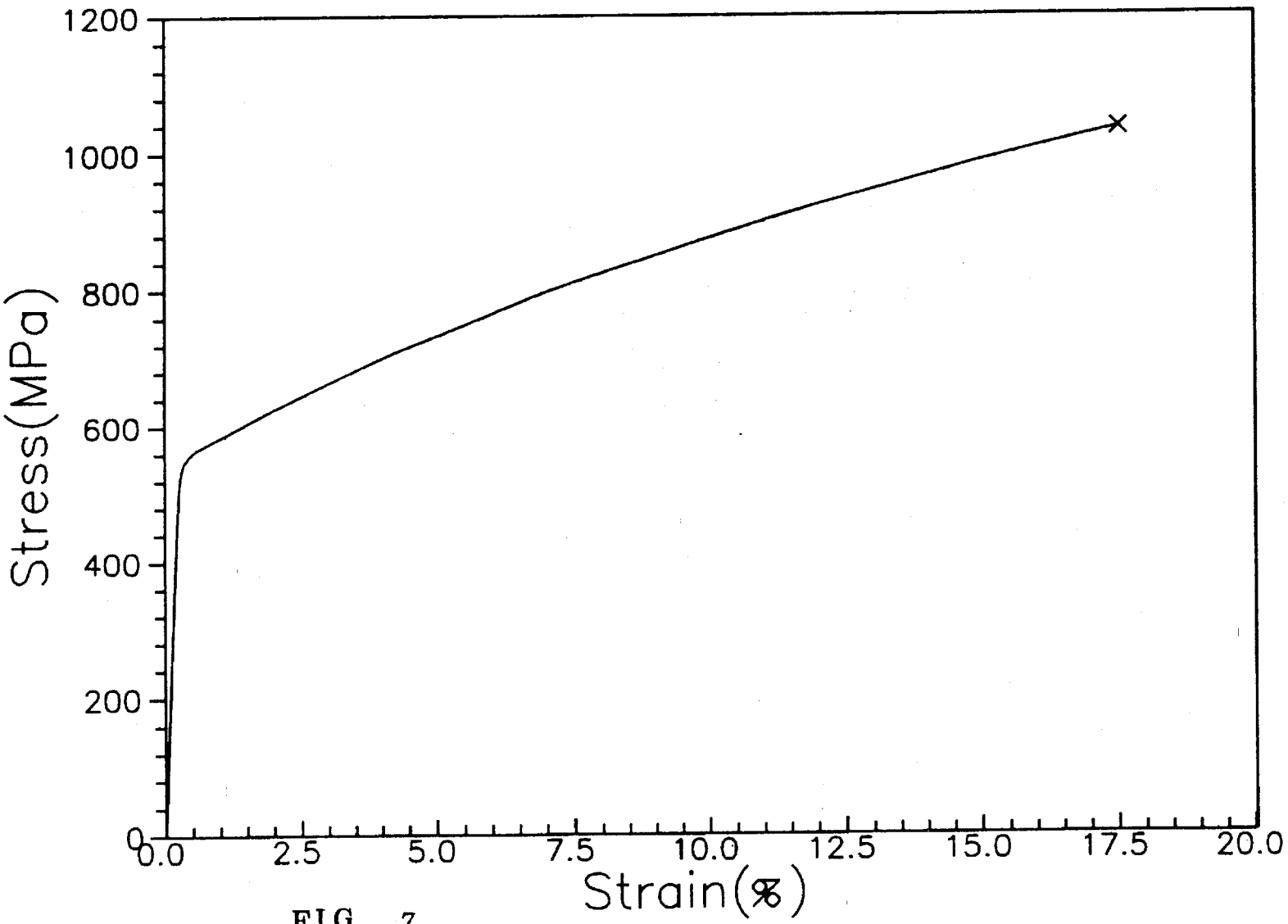
Figure 8:
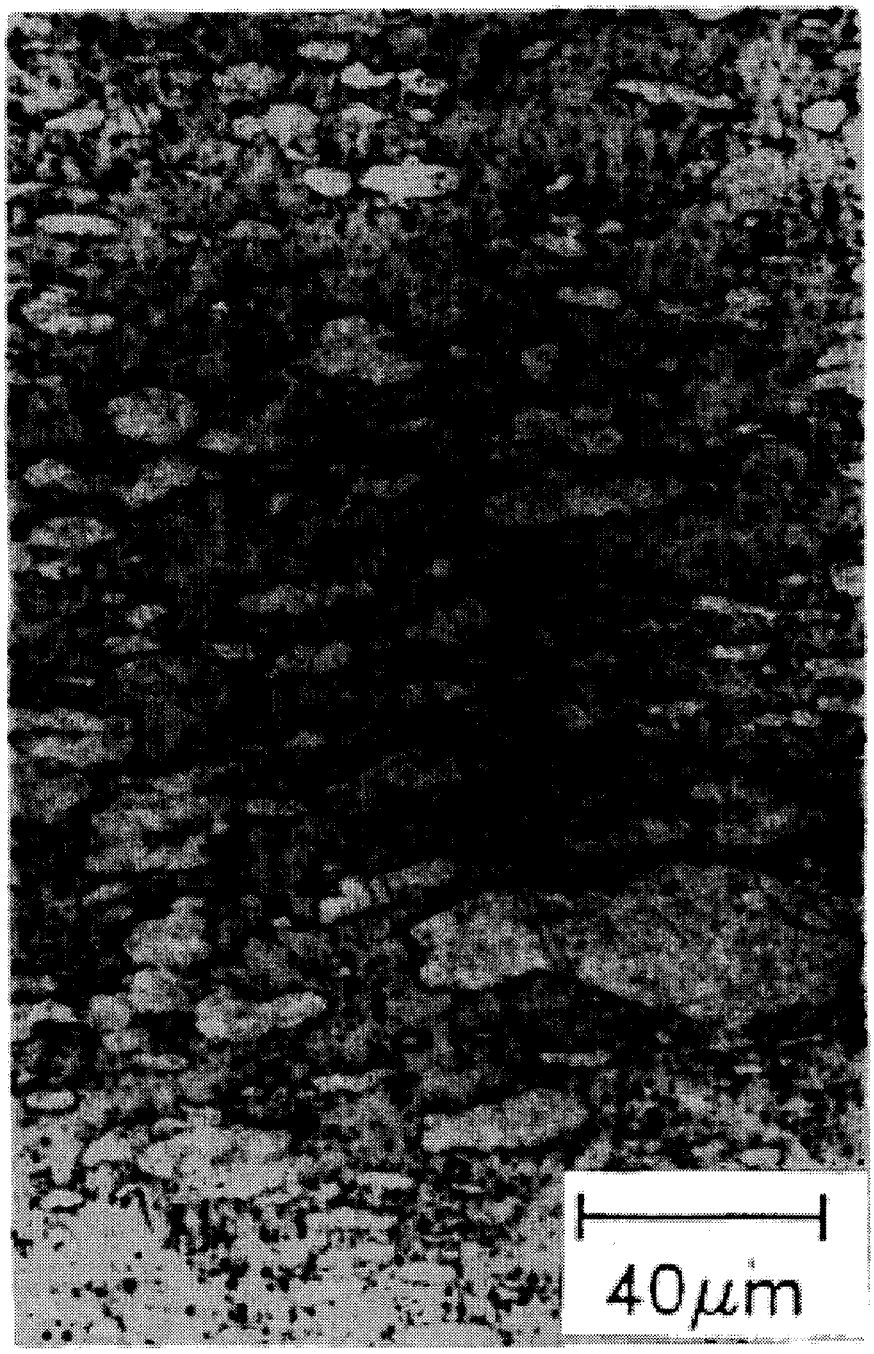

FIG. 6 is a metallograph showing the microstructure of a sample made of mixed composite powders after a heat treatment at 650° C. in 30 minutes;

FIG. 7 is a tensile test stress-strain curve for a composite powder metallurgy (CPM) specimen;

FIG. 8 is a metallograph of a test piece processed by a thermal treatment at 1200° C. in 8 hours;

DETAILED DESCRIPTION OF THE PREFERRED EMBODIMENT

Generally speaking, there are three ways to reduce metal ions in a solution to be deposited on an article: 1) the electro plating, 2) the chemical reducing plating, and 3) the replacing plating. According to the present invention, there are in fact the chemical reducing plating and the replacing plating included. That is to say, first, the nickel ions in the replacing plating solution replace the aluminum ions ionized from the aluminum powder to form a mono-atomic nickel layer on the surface of the powder; secondly, the reducing agent in the reducing solution permits the reduced nickel and boron ions to be deposited on the nickel layer. Because nickel has a property of spontaneous catalysis, the thickness of the nickel layer can be precisely controlled only if the adhesion between the surface of the aluminum powder and the nickel layer is satisfactory and only if the stability of the plating solution is as desired.

The electroless plating solution chiefly contains a metal salt and a reducing agent. For improving the reducing speed and for prolonging the life of the plating bath, the solution further contains a pH regulator, a buffer, a complexing agent, a stabilizer, and an improver.

Figure 1:
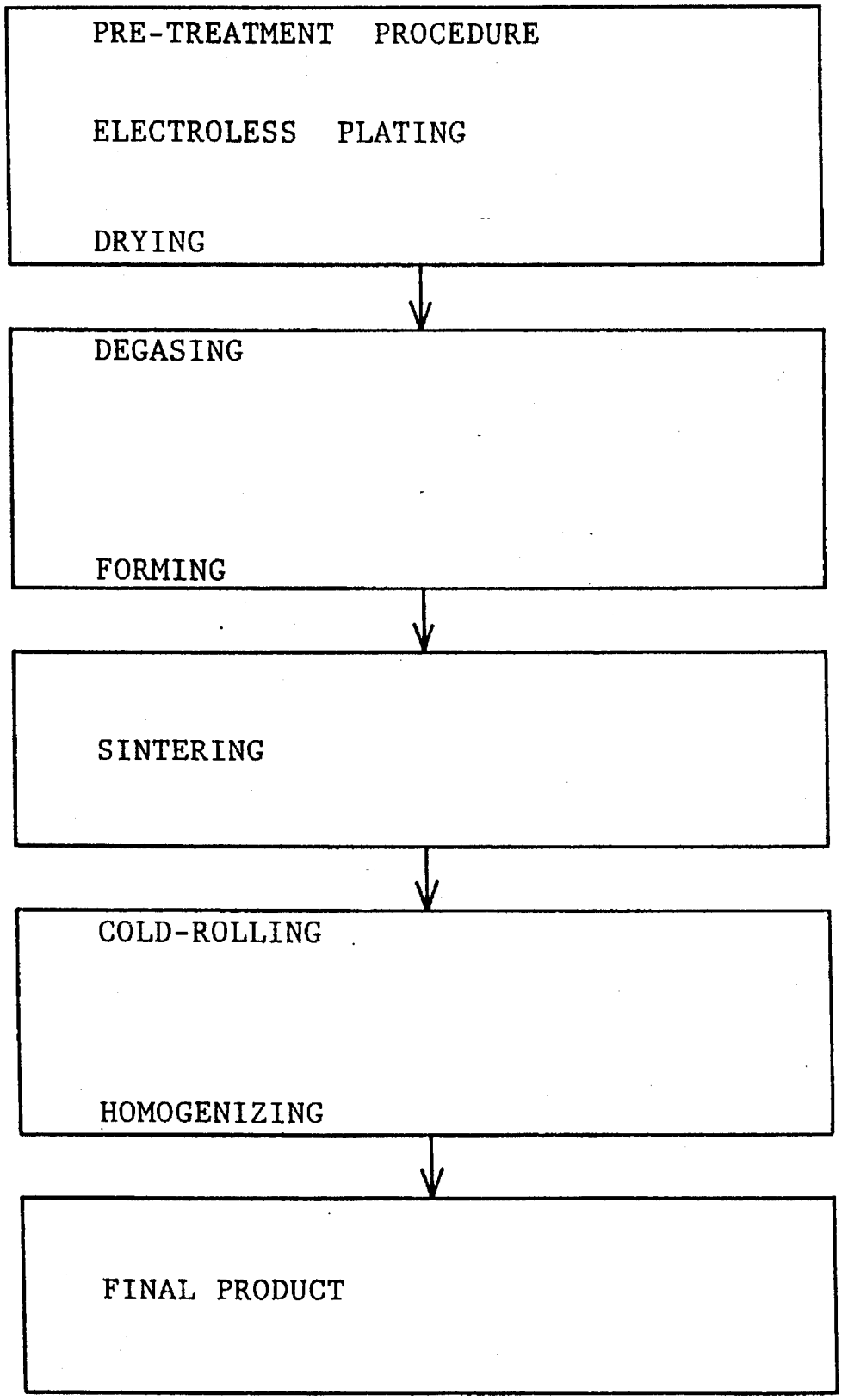
FIG. 1 is a flow chart according to the present invention.

A preparing method according to the present invention is shown in FIG. 1, and the key steps are discussed in detail as follows:

A) ELECTROLESS PLATING

The aluminum powder whose purity is above 99.5% and whose average diameter is 22 μm is obtained from CERAC Co. Besides, for adjusting the boron content of the $Ni_3Al$+B intermetallic compound to be about 0.1 wt% and for adjusting the nickel content of the compound, a proper amount of nickel powder (of 99.9% purity, average diameter 5μmm, marketed by CERAC Co.) is added into the electroless plating solution at a proper time.

The electroless plating includes the replacing plating and the reducing plating:

I) REPLACING PLATING

There are two possible replacing plating conditions shown as follows:

| CONDITION A | |
|---|---|
| nickel chloride ($NiCl_2.6H_2O$) | 15 g/l |
| sodium citrate ($Na_3C_6H_5O_7.2H_2O$) | 20 g/l |
| ammonia chloride ($NH_4Cl$) | 6 g/l |
| ammonium water ($NH_4OH$) regulating the pH value of the replacing solution to about 10 | |
| reaction temperature | room temperature |

CONDITION B

-continued

| | |
|---|---|
| nickel chloride ($NiCl_2.6H_2O$) | 30 g/l |
| sodium citrate ($Na_3C_6H_5O_7.2H_2O$) | 20 g/l |
| ammonium chloride ($NH_4Cl$) | 7 g/l |
| sodium fluoride (NaF) | 0.5 g/l |
| ammonia water ($NH_4OH$) regulating the pH value of said replacing solution to about 8.5. | |
| reaction temperature | room temperature |

Compared to the conventional pre-treatment procedures such as defatting the aluminum powder, flushing the aluminum powder with a basic solution, and flushing the aluminum powder with an acid solution, the replacing plating procedure performs effectively. Because the conventional defatting, flushing with a basic solution, and flushing with an acid solution cause a large amount of weight loss of aluminum during the pre-treatment procedure, an appropriate replacing plating is more suitable for pre-treating aluminum plates, aluminum flakes, and aluminum powder of large size. The difference between CONDITION A and CONDITION B is that some amount of NaF is added in CONDITION B to etch $Al_2O_3$ for lowering the pH value of the solution. That is to say, the weak acid NaF with Cl— and F— can etch away $Al_2O_3$ to execute the replacing reaction.

II) REDUCING PLATING

There are nine possible reducing plating conditions shown as follows:

| CONDITION 1 | |
|---|---|
| nickel chloride ($NiCl_2.6H_2O$) | 72 g/l |
| dimethylamine borane (DMAB) | 6 g/l |
| sodium acetate ($CH_3COONa.3H_2O$) | 22 g/l |
| lead nitrate ($Pb(NO_3)_2$) | 2 ppm |
| pH | 6–7 |
| reaction temperature | 70° C. |

CONDITION 2

| | |
|---|---|
| nickel chloride ($NiCl_2.6H_2O$) | 60 g/l |
| dimethylamine borane (DMAB) | 10 g/l |
| sodium citrate ($Na_3C_6H_5O_7.2H_2O$) | 100 g/l |
| ammonium chloride ($NH_4Cl$) | 50 g/l |
| lead nitrate ($Pb(NO_3)_2$) | 2 ppm |
| pH | 7–8 |
| reaction temperature | 70° C. |

CONDITION 3

| | |
|---|---|
| nickel chloride ($NiCl_2.6H_2O$) | 50 g/l |
| dimethylamine borane (DMAB) | 5 g/l |
| ammonia water ($NH_4OH$) | 50 ml/l |
| ammonium chloride ($NH_4Cl$) | 5 g/l |
| reaction temperature | room temperature |

CONDITION 4

| | |
|---|---|
| nickel chloride ($NiCl_2.6H_20$) | 15 g/l |
| dimethyl amine borane (DMAB) | 4 g/l |
| sodium citrate ($Na_3C_6H_5O_7.2H_2O$) | 20 g/l |
| ammonia water ($NH_4OH$) | 50 ml/l |
| reaction temperature | room temperature |

CONDITION 5

| | |
|---|---|
| nickel chloride ($NiCl_2.6H_2O$) | 30 g/l |
| dimethylamine borane (DMAB) | 3.5 g/l |
| malonic acid ($HOOCH_2COOH$) | 40 g/l |
| thiourea ($NH_2COSC_2H_5$) | 1 ppm |
| pH | 6–7 |
| reaction temperature | 70° C. |

CONDITION 6

| | |
|---|---|
| nickel chloride ($NiCl_2.6H_2O$) | 60 g/l |
| sodium borohydride ($NaBH_4$) | 2 g/l |
| sodium citrate ($Na_3C_6H_5O_7.2H_2O$) | 100 g/l |
| ammonium chloride ($NH_4Cl$) | 50 ml/l |

-continued

| | |
|---|---|
| lead nitrate ($Pb(NO_3)_2$) | 5 ppm |
| pH | 7–8 |
| reaction temperature | room temperature |
| CONDITION 7 | |
| nickel chloride ($NiCl_2.6H_2O$) | 60 g/l |
| sodium borohydride ($NaBH_4$) | 3 g/l |
| ammonia water ($NH_4OH$) | 200 ml/l |
| lead nitrate ($Pb(NO_3)_2$) | 2 ppm |
| pH | 8–10 |
| reaction temperature | room temperature |
| CONDITION 8 | |
| nickel chloride ($NiCl_2.6H_2O$) | 30 g/l |
| sodium borohydride ($NaBH_4$) | 2 g/l |
| ammonium chloride ($NH_4Cl$) | 5 g/l |
| sodium citrate ($Na_3C_6H_5O_7.2H_2O$) | 10 g/l |
| sodium acetate ($CH_3COONa.3H_2O$) | 20 g/l |
| lead nitrate ($Pb(NO_3)_2$) | 5 ppm |
| pH | 8–10 |
| reaction temperature | room temperature |
| CONDITION 9 | |
| nickel acetate ($Ni(C_2H_3O_2)_2.4H_2O$) | 60 g/l |
| hydrazine hydrate ($N_2H_4.H_2O$) | 100 ml/l |
| ethyl alcohol 2-hydroxylacetic acid ($HOCH_2COOH$) | 60 ml/l |
| ethylenediamine-tetraacetic acid (EDTA) | 25 g/l |
| pH | 8–10 |
| reaction temperature | 80°C. |

Figure 2A:
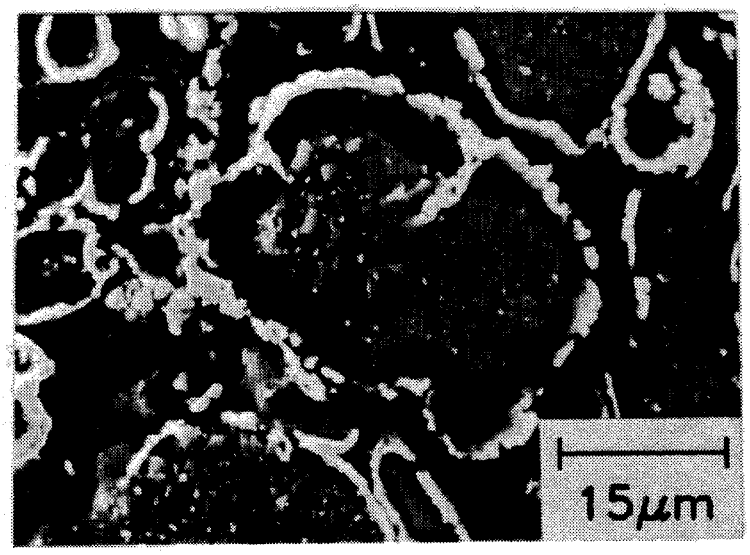
FIG. 2 is a SEM photograph which shows the composite powder according to an improper plating condition(at pH value 12)
Figure 2B:
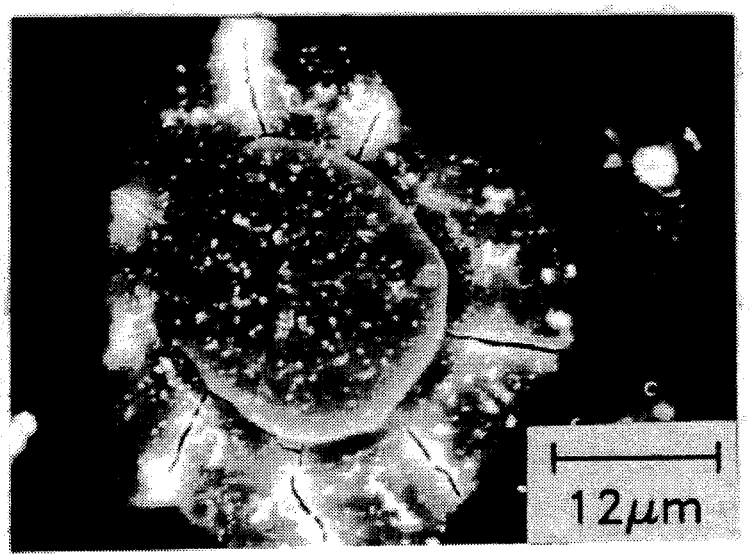
Figure 3A:
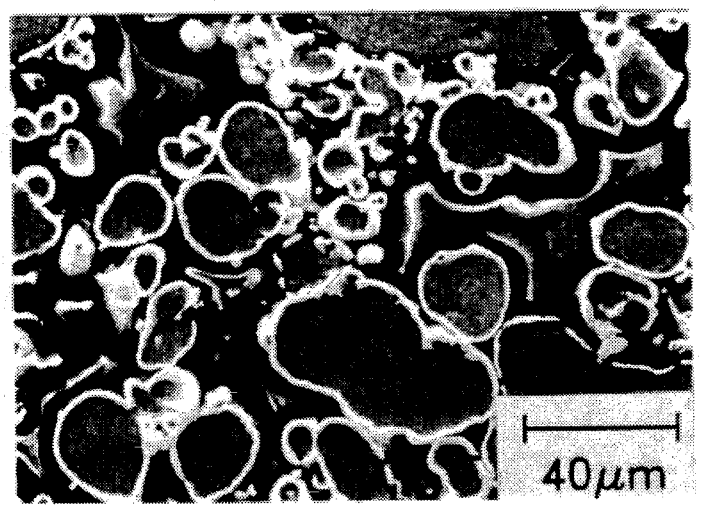
FIG. 3 is a SEM photograph which shows the composite powder according to a proper plating condition.
Figure 3B:
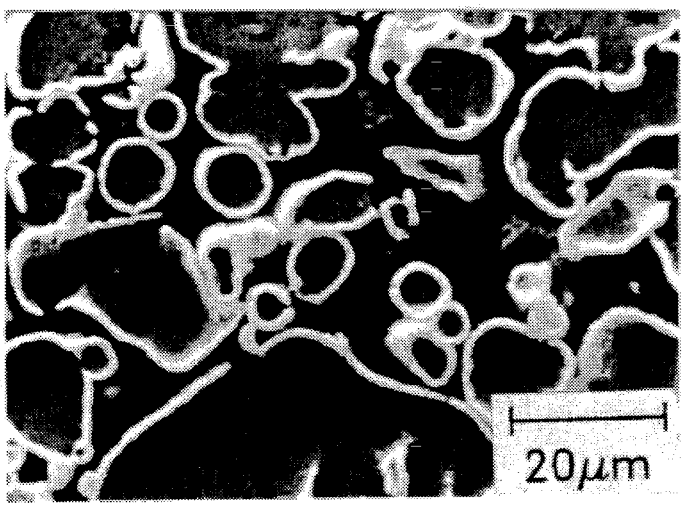
Figure 4:
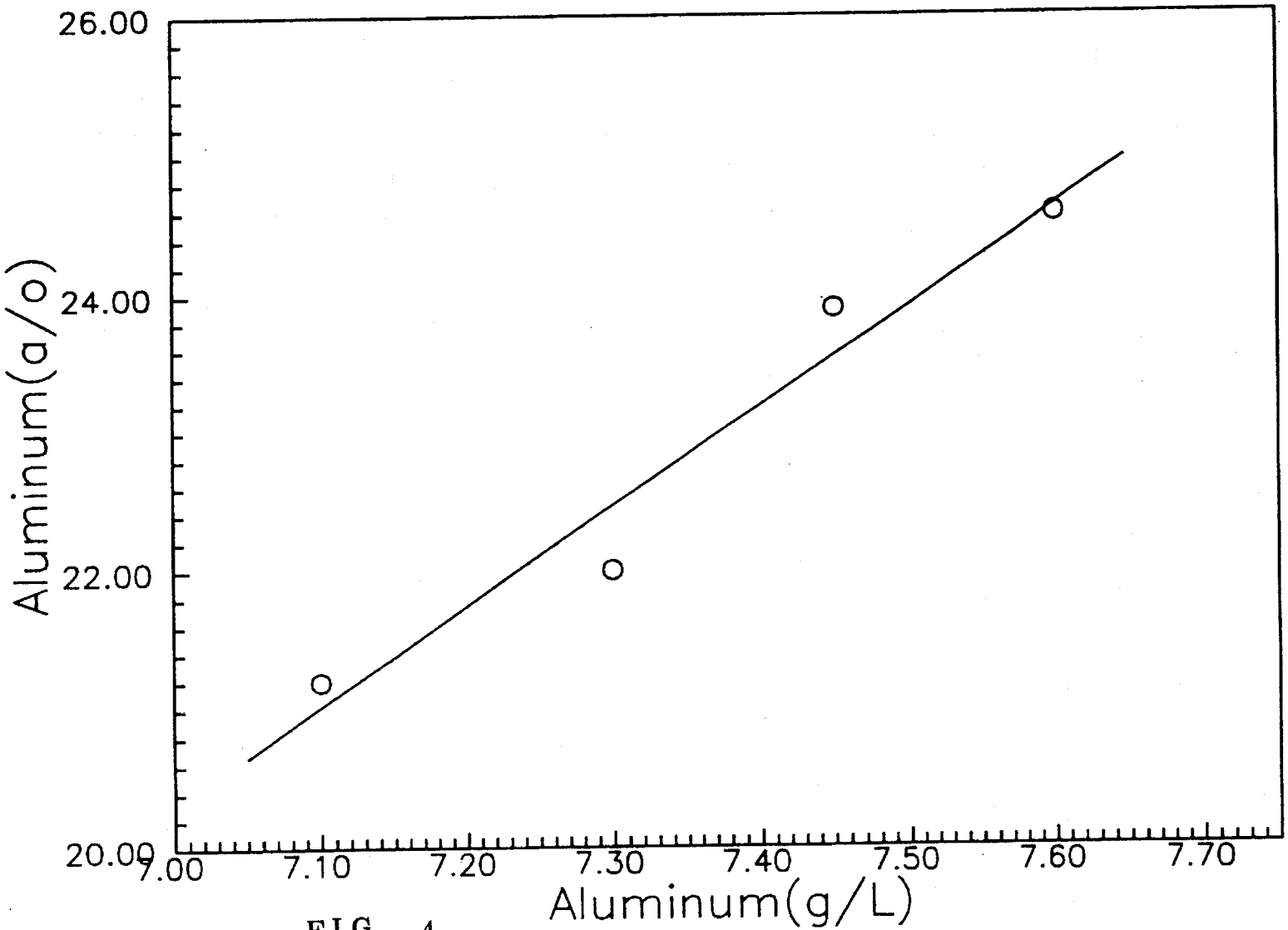

After the replacing plating and reducing plating procedures, a mixture of Ni—B—Ni and Ni—B—Al composite powders is formed. Owing to the high activity of aluminum, the aluminum is prone to react with H+ and OH– in the solution to form an aluminum hydroxide, so the pH value of the reducing solution is chosen to the neutral point and the reaction rate is chosen higher to lessen the time of the aluminum contacting with the solution. FIG. 2 shows a composite powder obtained through an improper plating condition (having a too high pH value). As shown in FIG. 2, there is a gray middle layer with fractures formed between aluminum and nickel. The fractures can be caused by the shrinkage of a glutinous aluminum hydroxide after the aluminum hydroxide is dried. FIG. 3 obtained by an SEM (CamScan) shows a composite powder through a proper plating condition allowing the aluminum particle to be covered by an uniform nickel layer. Comparing FIG. 2 with FIG. 3, we can find that there is no middle layer between nickel and aluminum in FIG. 3, and the subsequent steps such as forming and sintering ones show that this composite powder obtained in a proper plating condition performs well. Thus, the excellent Ni—Al interface quality is indirectly proved. The small white particles in FIG. 3 are a proper amount of nickel powder added into the reducing solution at five minutes before the reducing plating procedure is completed, and the object is to control the Ni and Al ratio of the Ni—Al compound and the concentration of boron. Although the boron content of the Ni—B alloy layer obtained by using DMAB as a reducing agent varies as the plating condition varies, the lowest boron content thereof is about 1% is much higher than the most proper boron content 0.1%. So, to add therein the nickel powder permits the boron content to be reduced to 0.1%. Table 1 shows the analysis results by ICP AES. The boron contents of different Ni—Al powder portions are all about 0.1%, and the contents of other metals such as Fe and Cu coming from the impurities in the reducing plating solution are relatively few. FIG. 4 shows the relation between the Al content of the Ni—Al compound and the weight of the added aluminum powder by varying the weight of added aluminum powder at a certain plating condition 4.

B) FORMING

The mixture of Ni—B—Ni and Ni—B—Al composite powders is first canned in a 304 stainless steel tube in air, then both ends of the tube are mechanically sealed to form a canister. Thus, the mixture is processed by a first thermal treatment with less than $10^{-5}$ torr at 450° C. in a vacuum tube furnace to be degassed, and a cold rolling to about 60% reduction in area is followed to form test flakes. It is noted that the

TABLE 1

| Added Concentration of Aluminum Powder | | | | |
|---|---|---|---|---|
| Al | 7.10 g/l | 7.30 g/l | 7.45 g/l | 7.60 g/l |
| Ni | balance | balance | balance | balance |
| Al | 21.23 at % | 22.04 at % | 23.89 at % | 24.62 at % |
| B | 0.119 wt % | 0.107 wt % | 0.125 wt % | 0.122 wt % |
| S | 0.002 wt % | 0.002 wt % | 0.002 wt % | 0.002 wt % |
| Fe | 0.0051 wt % | 0.0054 wt % | 0.0056 wt % | 0.0057 wt % |
| Cu | 0.0003 wt % | 0.0003 wt % | 0.0003 wt % | 0.0003 wt % |

composite powders absorb therein the hydrogen atoms generated during the electroless plating procedure because of the excellence in the hydrogen-absorbing behavior of nickel, then the degassing procedure is therefore very important.

C) SINTERING, COLD-ROLLING, AND HOMOGENIZING

The test flakes are processed by a second heat treatment at 650° C. to form a pre-sintered specimens, which are then reduced 30% in area by cold-rolling in a DBR-250 rolling mill and sintered at 1200° C. for two hours in the same furnace. After being released from the canister, the sintered specimens are cold-rolled to another 26% reduction in area and homogenized at 1200° C. for four hours in the same furnace. The X-ray diffraction patterns of the specimen in various steps in the sintering process are shown in FIG. 5. Comparing the two situations at 650° C. for 15 minutes and at 650° C. for 60 minutes, we can find that the prolongation of the specimen in the pre-sintering period from 15 minutes heat-treatment to 60 minutes heat-treatment does not significantly affect the relative intensity of each phase in the X-ray diffraction spectrum. FIG. 6 shows the metallograph of the specimen after a heat treatment at 650° C., and we can find that the black portions are pores being as large as the aluminum particle, so the portions should be pores generated from the reaction of aluminum and nickel. Around the pores there is an area of a gray thick layer, and according to the XRD patterns in FIG. 5 we can know that this gray area consists of $Al_3Ni_2$. From above discussions, we can get that the reaction mechanisms for forming the composite flakes at 650° C. are as follows: the atomized aluminum powders reacting with the nickel layer to form a new phase so that the compound $Al_3Ni_2$ and a large amount of reaction heat are generated, and the reaction heat in turn elevates the local temperature of the flakes so that there is a transient liquid existing between the powder to speed up the reaction; whereas the formed compound whose melting point is higher and the diffusion rate of nickel and aluminum in the compound is slower so that the rate of nickel reacting with $Al_3Ni_2$ is slowed down, thus the composition at 650° C. heat-treatment for 15 minutes and 650° C. for 60 minutes are almost the same; the reaction of aluminum and nickel to form the Ni—Al compound is one which causes the entire volume to be shrunk, so there are generated pores whose sizes are similar to the ones of the aluminum particles, and by the fact that a gray layer of a second phase developing around the inner wall of each pore has a uniform thickness and that there is no un-reacted aluminum left, it can be proved that the interface quality between nickel and aluminum is satisfactory. From FIG. 5, we can also be informed that the reacting mechanisms of the transformation from Ni and Al to $Ni_3Al$ are $Ni+Al \rightarrow Ni+Al_3Ni_2 \rightarrow Ni+NiAl+Al_3Ni_2 \rightarrow Ni+NiAl+Ni_3Al \rightarrow Ni3Al$. In other words, the intermetallic compound containing higher content of aluminum is first formed in the entire reaction, and the formation rate (especially of $Al_3Ni_2$) is very fast which is achieved chiefly by means of a fast diffusion rate made possible by a transient liquid state. The post solid in this stage diffuses into a homogenized mechanism gradually formed into an intermetallic compound having a higher nickel content as the temperature is raised and the time passes to finally obtain the $Ni_3Al$ of a mono-phase.

In addition, the physical properties of the specimen are discussed now. The tensile tests were performed on specimens of gauge length 25.4 mm (ASTM standard) at room temperature, and a testing machine (MTS 810) with an initial strain rate $1.0\times10^{-4}$ $s^{-1}$ was employed. The test record is obtained from a X-Y recorder and a personal computer. FIG. 7 is a typical tensile test stress-strain curve for an air test specimen.

The test is conducted on a specimen obtained by a composite powder metallurgy (CPM) where the aluminum content ranges from 23 a/o to 25 a/o. Its elasticity ranges from 160 GPa to 200 GPa which respectively correspond to theoreticle values. Its yield strength ranges from 420 MPa to 580 MPa which is twice that of a vacuum molten test piece. Its elongation percentage ranges only from 12% to 17% which is higher than that of most $Ni_3Al+B$ compounds produced by other powder metallurgy methods. FIG. 8 shows a metallograph of a test piece processed by a homogenizing procedure at 1200° C. for eight hours.

While the present invention has been described in connection with what are presently considered to be the most particle and preferred embodiments, it is to be understood that the invention is to be limited to the disclosed embodiments but on the contrary, is intended to cover various modifications and equivalent arragements included within the spirit and scope of the appended claims which scope is to be accorded the brodest interpretation so as to encompass all such modification and equivalent structures.

What is claimed is:

1. An electroless plating method of an Ni—Al intermetallic compound comprising steps of:

a) providing a reducing solution containing a reducing agent and reducing nickel ions;

b) adding a proper amount of aluminum powder to said reducing solution; and c) permitting said reducing agent to reduce said reducing nickel ions to be deposited on said aluminum powder.

2. A method according to claim 1 wherein said aluminum powder is processed by a pre-treatment procedure.

3. A method according to claim 2 wherein said pre-treatment procedure includes steps of defatting said aluminum powder, flushing said aluminum powder with a basic solution, and flushing said aluminum powder with an acid solution.

4. A method according to claim 3 wherein said pre-treatment procedure further includes a step of subjecting said aluminum powder to an ultrasonic vibration to speed up said pre-treatment procedure and improve a uniformity of said aluminum powder.

5. A method according to claim 2 wherein said pre-treatment procedure includes steps of:

d) providing said aluminum powder;

e) providing a replacing solution containing replacing nickel ions; and f) permitting said replacing nickel ions to replace aluminum ions oxidized from said aluminum powder for forming a thin mono-layer of nickel on a surface of said aluminum powder.

6. A method according to claim 5 wherein said aluminum powder whose purity is about 99.5% and whose average diameter is about 22 μm.

7. A method according to claim 5 wherein said replacing solution includes a metal salt and a reducing agent.

8. A method according to claim 6 wherein said replacing solution further includes at least one selected from a group consisting of a pH regulator, a buffer, a complexing agent, a stabilizer, and an improver.

9. A method according to claim 5 wherein said replacing solution includes nickel chloride ($NiCl_2.6H_2O$), sodium citrate ($Na_3C_6H_5O_7.2H_2O$), ammonium chloride ($NH_4Cl$), and ammonia water ($NH_4OH$) regulating a pH value of said replacing solution above about 7.

10. A method according to claim 9 wherein said pH value is preferable between about 9 and about 11.

11. A method according to claim 5 wherein said replacing solution includes nickel chloride ($NiCl_2.6H_2O$), sodium citrate ($Na_3C_6H_5O_7.2H_2O$), ammonium chloride ($NH_4Cl$), sodium fluoride (NaF) and ammonia water ($NH_4OH$) regulating a pH value of said replacing solution above about 7.

12. A method according to claim 11 wherein said pH value is preferable between about 7.5 and about 9.5.

13. A method according to claim 1 wherein said reducing solution includes a metal salt and a reducing agent.

14. A method according to claim 13 wherein said reducing solution further includes a pH value regulator, a buffer, a complexing agent, a stabilizer, and an improver.

15. A method according to claim 1 wherein said replacing solution has a pH value ranging from about 6 to about 7 and a reaction temperature about 70° C., and includes nickel chloride ($NiCl_2.6H_2O$), dimethylamine borane (DMAB), sodium acetate ($CH_3COONa.3H_2O$), and lead nitrate ($Pb(NO_3)_2$).

16. A method according to claim 1 wherein said replacing solution has a pH value ranging from about 7 to about 8 and a reaction temperature about 70° C., and includes nickel chloride ($NiCl_2.6H_2O$), dimethylamine borane (DMAB), sodium citrate ($Na_3C_6H_5O7$ $.2H_2O$), ammonia chloride ($NH_4Cl$), and lead nitrate ($Pb(NO_3)_2$).

17. A method according to claim 1 wherein said replacing solution has a reaction temperature at room temperature, and includes nickel chloride ($NiCl_2.6H_2O$), dimethylamine borane (DMAB), ammonia water ($NH_4OH$), and ammonia chloride ($NH_4Cl$).

18. A method according to claim 1 wherein said replacing solution has a reaction temperature at room temperature, and includes nickel chloride ($NiCl_2.6H_2O$), dimethylamine borane (DMAB), sodium citrate ($Na_3C_6H_5O_7.2H_2O$), and ammonia water ($NH_4OH$).

19. A method according to claim 1 wherein said replacing solution has a pH value ranging from about 6 to about 7 and a reaction temperature about 70° C., and includes nickel chloride ($NiCl_2.6H_2O$), dimethylamine borane (DMAB), monalic acid ($HOOCH_2COOH$), and thiourea ($NH_2COSC_2H_5$).

20. A method according to claim 1 wherein said replacing solution has a pH value ranging from about 7 to about 8 and a reaction temperature at room temperature, and includes nickel chloride ($NiCl_2.6H_2O$), sodium borohydride ($NaBH_4$), sodium citrate ($Na_3C_6H_5O_7.2H_2O$), ammonia chloride ($NH_4Cl$), and lead nitrate ($Pb(NO_3)_2$).

21. A method according to claim 1 wherein said replacing solution has a pH value ranging from about 8 to about 10 and a reaction temperature at room temperature, and includes nickel chloride ($NiCl_2.6H_2O$), sodium borohydride ($NaBH_4$), ammonia water ($NH_4OH$), and lead nitrate ($Pb(NO_3)_2$).

22. A method according to claim 1 wherein said replacing solution has a pH value ranging from about 8 to about 10 and a reaction temperature at room temperature, and includes nickel chloride ($NiCl_2.6H_2O$), sodium borohydride ($NaBH_4$), ammonia chloride ($NH_4Cl$), sodium citrate ($Na_3C_6H_5O_7.2H_2O$) sodium acetate ($CH_3COONa.3H_2O$), and lead nitrate ($Pb(NO_3)_2$).

23. A method according to claim 1 wherein said replacing solution has a pH value ranging from about 8 to about 10 and a reaction temperature about 80° C., and includes nickel acetate ($Ni(C_2H_3O_2)_2.4H_2O$), hyrazine hydrate ($N_2H_4.H_2O$) ethyl alcohol ($HOCH_2COOH$), and ethylenediaminetetraacetic acid (EDTA).

24. A method according claim 1 wherein said reducing solution contains boron ions for forming a Ni—B—Al composite powder.

25. A method according to claim 24, further comprising steps of:

g) providing a pure nickel powder;

h) adding a proper amount of said pure nickel powder in said reducing solution at a proper time for forming a Ni—B—Ni composite powder; and i) obtaining a mixture of said Ni—B—Al composite powder and Ni—B—Ni composite powder.

26. A method according to claim 25 wherein said proper amount of pure nickel powder further adjusts a concentration of said boron ions.

27. A method according to claim 25 wherein said nickel powder has a purity about 99.9% and an average diameter about 5 μm.

28. A method according to claim 1 wherein a reaction temperature of said reducing solution ranges from about 0° C. to about 100° C.

29. A method according to claim 1 wherein said Ni—Al intermetallic compound is one selected from a group consisting of $Ni_3Al$, NiAl, $Ni_2Al_3$, $NiAl_3$, $Ni_3Al$+B, NiAl+B, $Ni_2Al_3$+B, and $NiAl_3$+B.

* * * * *